US007127195B2

(12) United States Patent
Kimura et al.

(10) Patent No.: US 7,127,195 B2
(45) Date of Patent: Oct. 24, 2006

(54) IMAGE FORMING APPARATUS AND IMAGE TRANSFERRING UNIT FOR USE IN THE SAME

(75) Inventors: Yoshiyuki Kimura, Tokyo (JP); Takeshi Saito, Tokyo (JP); Atsushi Sampe, Kanagawa (JP); Misao Tanzawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/213,868

(22) Filed: Aug. 30, 2005

(65) Prior Publication Data

US 2005/0281584 A1 Dec. 22, 2005

Related U.S. Application Data

(63) Continuation of application No. 10/653,097, filed on Sep. 3, 2003, now Pat. No. 6,996,354.

(30) Foreign Application Priority Data

Sep. 4, 2002 (JP) ..... 2002-258681

(51) Int. Cl.
*G03G 15/02* (2006.01)
*G03G 15/08* (2006.01)

(52) U.S. Cl. ..... 399/116; 399/121

(58) Field of Classification Search ..... 399/110, 399/111, 113, 116, 117, 121
See application file for complete search history.

(56) References Cited

U.S. PATENT DOCUMENTS 4,866,482 A * 9/1989 Hirasawa et al. ..... 399/13
4,926,219 A * 5/1990 Hirasawa et al. ..... 399/113 X
4,974,020 A * 11/1990 Takamatsu et al. ..... 399/113 X
5,371,575 A 12/1994 Sekino et al.
5,557,382 A 9/1996 Tatsumi et al.
5,574,538 A 11/1996 Takahashi et al.
5,587,769 A 12/1996 Sawada et al.
5,614,998 A 3/1997 Sanpe
5,638,158 A 6/1997 Sanpe et al.
5,697,020 A 12/1997 Sato et al.
5,797,069 A 8/1998 Kimura et al.
5,887,228 A 3/1999 Motohashi et al.
5,915,156 A 6/1999 Kizaki et al.
5,918,087 A 6/1999 Kimura et al.
5,991,569 A 11/1999 Sugihara et al.
6,026,255 A 2/2000 Kizaki et al.
6,070,037 A 5/2000 Sugihara et al.
6,072,967 A 6/2000 Sugihara et al.
6,104,900 A 8/2000 Ishikawa et al.

(Continued)

FOREIGN PATENT DOCUMENTS

EP 0 643 338 3/1995

(Continued)

OTHER PUBLICATIONS

Patent Abstract of Japan, JP 3-200980, Sep. 2, 1991.

*Primary Examiner*—Sandra L. Brase
(74) *Attorney, Agent, or Firm*—Oblon, Spivak, McClelland, Maier & Neustadt, P.C.

(57) ABSTRACT

In an image forming apparatus configured to form a toner image on a photoconductive element and transfer it to a recording medium of the present invention, the photoconductive element and an image transferring member pressed thereagainst are constructed into an image transferring unit. The image transferring unit is removable from the casing of the apparatus independently of image forming devices arranged around the photoconductive element other than the image transferring member.

19 Claims, 12 Drawing Sheets

U.S. PATENT DOCUMENTS

| | | | | |
|---|---|---|---|---|
| 6,122,469 | A | 9/2000 | Miura et al. | |
| 6,141,519 | A | 10/2000 | Sato | |
| 6,141,521 | A | 10/2000 | Yuuki et al. | |
| 6,336,020 | B1 | 1/2002 | Ishikawa et al. | |
| RE37,645 | E | 4/2002 | Takahashi et al. | |
| 6,463,236 | B1 * | 10/2002 | Morikami et al. | 399/121 |
| 6,477,346 | B1 * | 11/2002 | Yahagi | 399/117 |
| 6,484,003 | B1 | 11/2002 | Tokutake et al. | |
| 6,493,528 | B1 | 12/2002 | Sameshima et al. | |
| 6,522,845 | B1 | 2/2003 | Sameshima | |
| 6,522,861 | B1 | 2/2003 | Tokutake et al. | |
| 6,560,414 | B1 | 5/2003 | Suda et al. | |
| 6,601,991 | B1 | 8/2003 | Sampe | |
| 6,611,672 | B1 | 8/2003 | Aoki et al. | |
| 6,775,494 | B1 | 8/2004 | Kusaba et al. | |
| 6,823,155 | B1 * | 11/2004 | Tsuda et al. | 399/111 |
| 2002/0118989 | A1 | 8/2002 | Tokutake et al. | |
| 2004/0170447 | A1 | 9/2004 | Arai et al. | |

FOREIGN PATENT DOCUMENTS

| | | |
|---|---|---|
| JP | 3-84837 | 8/1991 |
| JP | 3-200160 | 9/1991 |
| JP | 3-266857 | 11/1991 |
| JP | 4-114174 | 4/1992 |
| JP | 5-45951 | 2/1993 |
| JP | 6-35264 | 2/1994 |
| JP | 9-179474 | 7/1997 |
| JP | 2000-227688 | 8/2000 |
| JP | 2000-284555 | 10/2000 |
| JP | 2002-108049 | 4/2002 |
| JP | 2002-108050 | 4/2002 |
| JP | 2002-182539 | 6/2002 |
| JP | 2002-229412 | 8/2002 |

* cited by examiner

IMAGE FORMING APPARATUS AND IMAGE TRANSFERRING UNIT FOR USE IN THE SAME

BACKGROUND OF THE INVENTION

1. Field of the Invention

The present invention relates to an electrophotographic image forming apparatus and an image transferring unit for use in the same.

2. Description of the Background Art

A copier, printer or similar electrophotographic image forming apparatus includes a photoconductive drum or similar photoconductive element on which a toner image is to be formed. Arranged around the drum are a charger, a developing unit and a cleaning unit, which are image forming means joining in the formation of the toner image. An image transfer roller and an intermediate image transfer belt transfer the toner image from the drum to a sheet or recording medium.

The various members stated above each have a particular life determined beforehand in accordance with the material and the condition of use and are replaced when the life ends. Each member sometimes must be replaced before the end of life due to the deposition of impurities or scratches.

While the various members may be configured to be replaced individually, such a configuration not only increases the frequency of replacement and therefore time and labor necessary for replacement, but also sometimes scratch or otherwise damage the members around the member being replaced. In light of this, a current trend in the imaging art is toward an image forming apparatus in which the drum, charger, developing unit and cleaning unit are constructed into a single process cartridge bodily removable from the apparatus.

On the other hand, there has recently been proposed an image forming apparatus in which the drum, which is more expensive than the other members, is extended in life and replaceable independently of the other members. In this configuration, when the quality of an image transferred to a sheet is lowered due to scratches formed on the drum, the drum is replaced alone.

However, scratches formed on the drum are, in many cases, ascribable to an intermediate image transfer belt, sheet conveying belt, image transfer roller or similar image transferring member pressed against the drum. It is therefore likely that after the replacement of the scratched drum a new drum is also scratched in a short period of time and again lowers image quality unless the image transferring member, causative of the scratches, is replaced.

For example, in a color image forming apparatus including an intermediate image transfer belt, when impurities, including residual toner and paper dust, adhere to the outer surface of the belt, they scratch the above surface in the form of spots when pressed against the surface. As the impurities are repeatedly pressed against the drum, the spot-like scratches on the drum grow little by little and soon become stripe-like scratches. Such scratches capture a large amount of toner and appear in an image transferred to the sheet as black stripes.

On the other hand, when the impurities enter nips between the inner surface of the intermediate image transfer belt and rollers supporting it, they cause corresponding projections to appear on the outer surface of the belt. The projections of the belt also scratch the drum in the form of spots when pressed against the drum. These spot-like scratches also become stripe-like scratches.

In a color image forming apparatus of the type using a conveying belt for conveying a sheet in place of the intermediate image transfer belt, the conveying belt is not directly pressed against the drum during image formation because a sheet intervenes between the belt and the drum. However, the belt is pressed against the drum at the interval between consecutive sheets. As a result, when impurities adhered to the outer surface of the belt or enter nips between the belt and rollers supporting it and cause the outer surface of the belt to project, stripe-like scratches are also formed on the drum. This is also true with a monochromatic image forming apparatus including an image transfer roller pressed against the drum.

Technologies relating to the present invention are also disclosed in, e.g., Japanese Patent Laid-Open Publication Nos. 2000-227688 and 2002-108049.

SUMMARY OF THE INVENTION

It is an object of the present invention to allow, when image quality is lowered due to scratches formed on a photoconductive element, the drum and an image transferring member, causative of the scratches, to be replaced together for thereby obviating time- and labor-consuming replacing work and freeing a new photoconductive element from the same scratches.

It is another object of the present invention to allow, when the degradation of image quality is not ascribable to the image transferring member, but is ascribable to the photoconductive element itself, e.g., when charge products deposit on the element in the from of a film, only the element to be replaced.

In accordance with the present invention, in an image forming apparatus for forming a toner image on the circumferential surface of a photoconductive element and transferring it to a recording medium, the photoconductive element and an image transferring member, pressed against the above surface, are constructed into an image transferring unit. The image transferring unit is removable from the casing of the apparatus independently of image forming devices arranged around the photoconductive element other than the image transferring member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
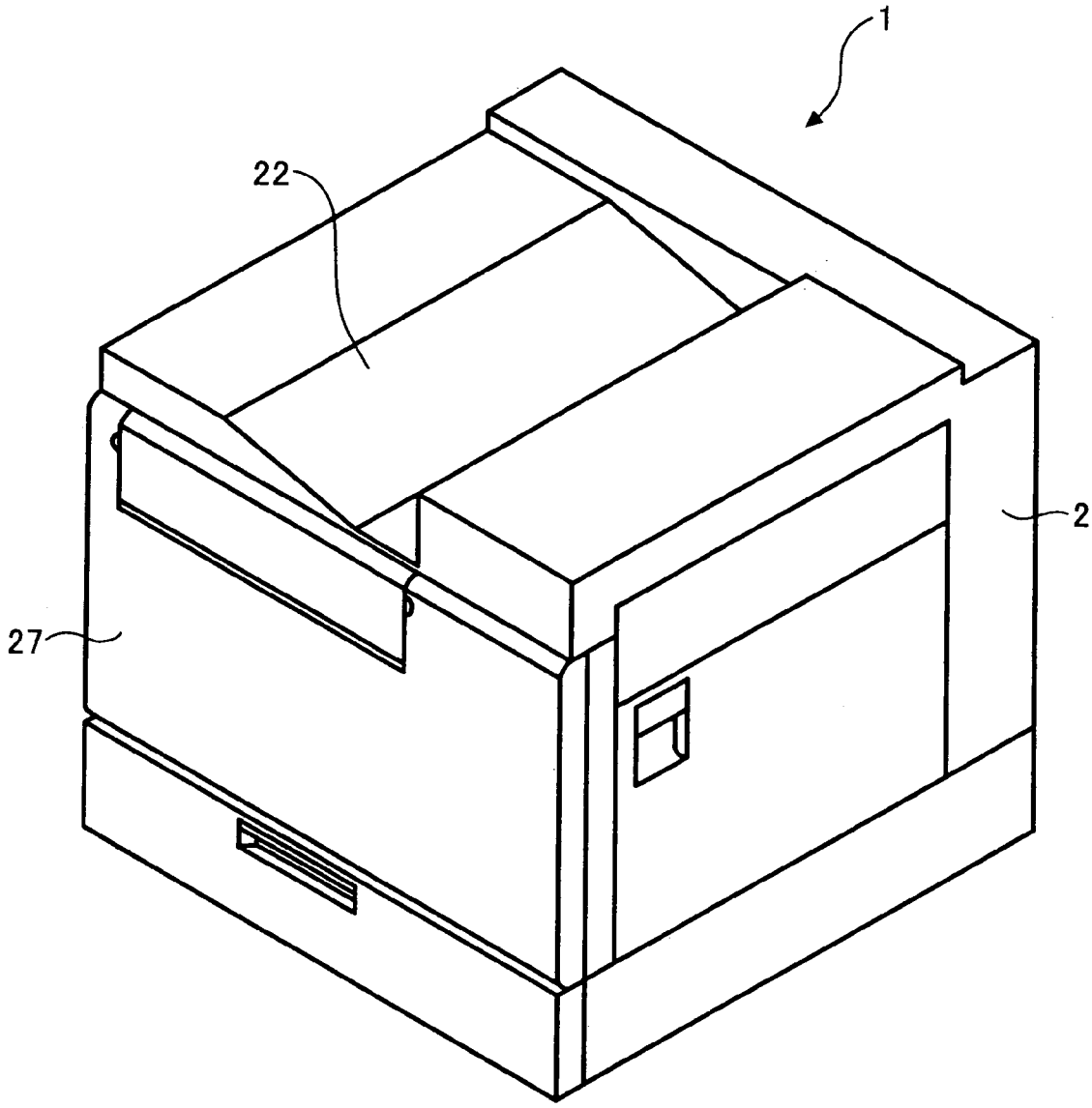
FIG. 1 is an isometric view showing a first embodiment of the image forming apparatus in accordance with the present invention.
Figure 2:
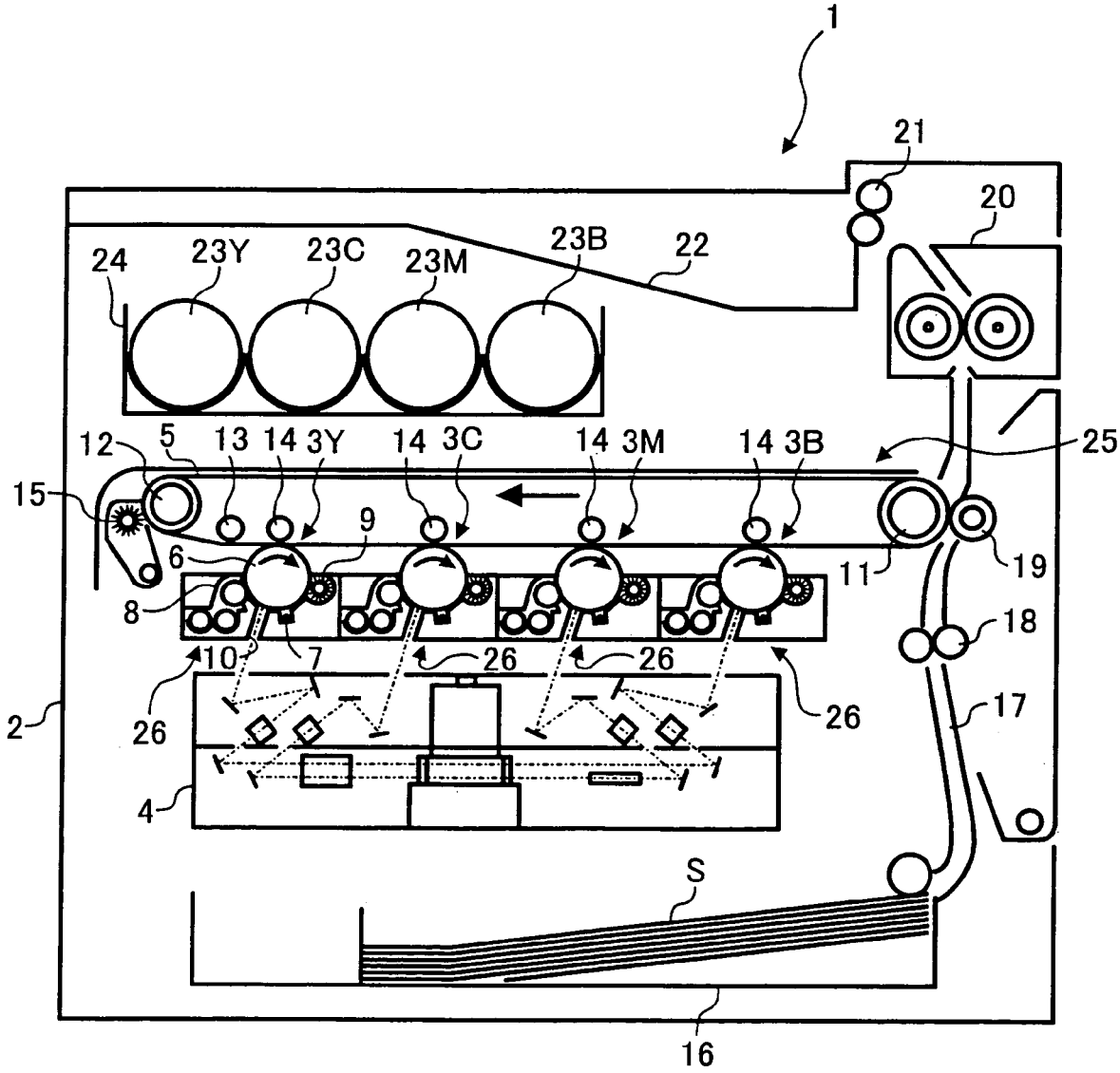
FIG. 2 is a front view showing the inside of the apparatus of FIG. 1.

Referring to FIGS. 1 and 2 of the drawings, a first embodiment of the image forming apparatus in accordance with the present invention is shown and implemented as a color printer by way of example. As shown, the color printer, generally 1, includes a casing 2. Four image forming stations 3Y (yellow), 3C (cyan), 3M (magenta) and 3B (black), an exposing unit 4 and an endless, intermediate image transfer belt or image transferring member 5 are arranged in substantially the center portion of the casing 2. Because the image forming stations 3Y through 3B are identical in configuration with each other except for the color of toner to use, structural elements thereof are sometimes also distinguished from each other by suffixes Y through B.

The image forming stations 3Y through 3B each include a photoconductive drum or photoconductive element 6 rotatable in a direction indicated by an arrow in FIG. 2. Arranged around the drum 6 are a charger 7, a developing unit 8 and a cleaning unit 9 each constituting particular image forming means.

The drum 6 is made up of a hollow cylindrical core formed of aluminum and provided with a diameter of 30 mm to 100 mm and a photoconductive layer formed on the core. The charger 7 uniformly charges the surface of the drum 6 without contacting the drum 6. The exposing unit 4 scans the surface of the drum 6 thus charged with a laser beam in accordance with image data to thereby form a latent image. A slit 10 is positioned between the charger 7 and the developing unit 8, so that the laser beam from the exposing unit 4 can scan the drum 6 therethrough.

Figure 9:
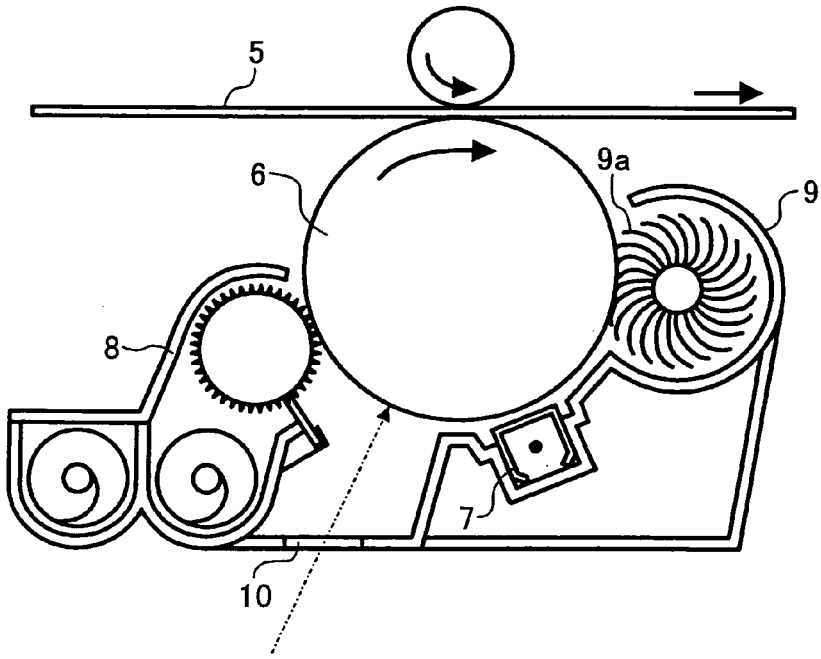
FIG. 9 is a sectional front view showing the developing unit.

The developing unit 8 deposits toner on the latent image formed on the drum 6 to thereby produce a corresponding toner image. In the illustrative embodiment, the developing unit 8 effects development without contacting the drum 6. The cleaning unit 9 removes toner left on the drum 6 after image transfer and, in the illustrative embodiment, uses a brush held in contact with the drum 6. As shown in FIG. 9, the cleaning unit 9 is formed with an opening 9*a* facing upward, i.e., positioned such that the opening 9*a* is inclined relative to a horizontal plane by an angle smaller than 90°.

The intermediate image transfer belt (simply belt hereinafter) 5 includes a base implemented by a 50 μm to 600 μm thick resin film or rubber. The belt 5 is provided with resistance that allows the toner image to be transferred from the drum 6 to the belt 5. The belt 5 is passed over rollers 11, 12 and 13 and caused to turn in a direction indicated by an arrow in FIG. 2. Four image transfer rollers 14 are positioned inside of the loop of the belt 6 for transferring toner images of different colors from the drums 6 to the belt 5 one above the other. This image transfer will be referred to as primary image transfer. A cleaning unit 15 is positioned outside of the loop of the belt 6 for removing toner left on the belt 5 after image transfer and other impurities, including paper dust, from the belt 6.

A sheet cassette 16 is positioned below the four image forming stations 4Y through 4B and exposing unit 4 and loaded with a stack of sheets or recording media S. The sheets S are sequentially fed from the sheet cassette 16 one by one, the top sheet S being first. The sheet S, fed from the sheet cassettes 16, is conveyed along a sheet path 17 on which a registration roller pair 18, an image transfer roller for secondary image transfer 19, a fixing unit 20 and an outlet roller pair 21 are arranged.

The registration roller pair 18 stops the sheet S reached its nip and then starts conveying it at preselected timing toward a secondary image transfer position between the belt 5 and the image transfer roller 19. At the secondary image transfer position, a composite color toner image formed on the belt 5 is transferred to the sheet S.

The fixing unit 20 fixes the toner image transferred to the sheet S with heat and pressure. The sheet S with the toner image thus fixed is driven out to a stack tray 22, which is formed on the top of the casing 2, by the outlet roller pair 21.

A toner bottle storage 24 is positioned above the image forming stations 3Y through 3B and belt 5 and stores toner containers 23Y, 23C, 23M and 23B removably mounted thereto. The toner containers 23Y through 23B each store toner of a particular color to be replenished to associated one of the developing stations 3Y through 3B by a respective conveying mechanism not shown.

In the illustrative embodiment, the four drums 6 and belt 5 are constructed into a single image transferring unit 25. Also, at each of the image forming stations 3Y through 3B, the charger 7, developing unit 8 and cleaning unit 9 are constructed into a single image forming unit 26. Four image forming units 26 thus configured are mounted on a single image forming unit tray 26*a*, see FIGS. 4 and 6, and each is removable from the tray 26*a*.

Figure 4:
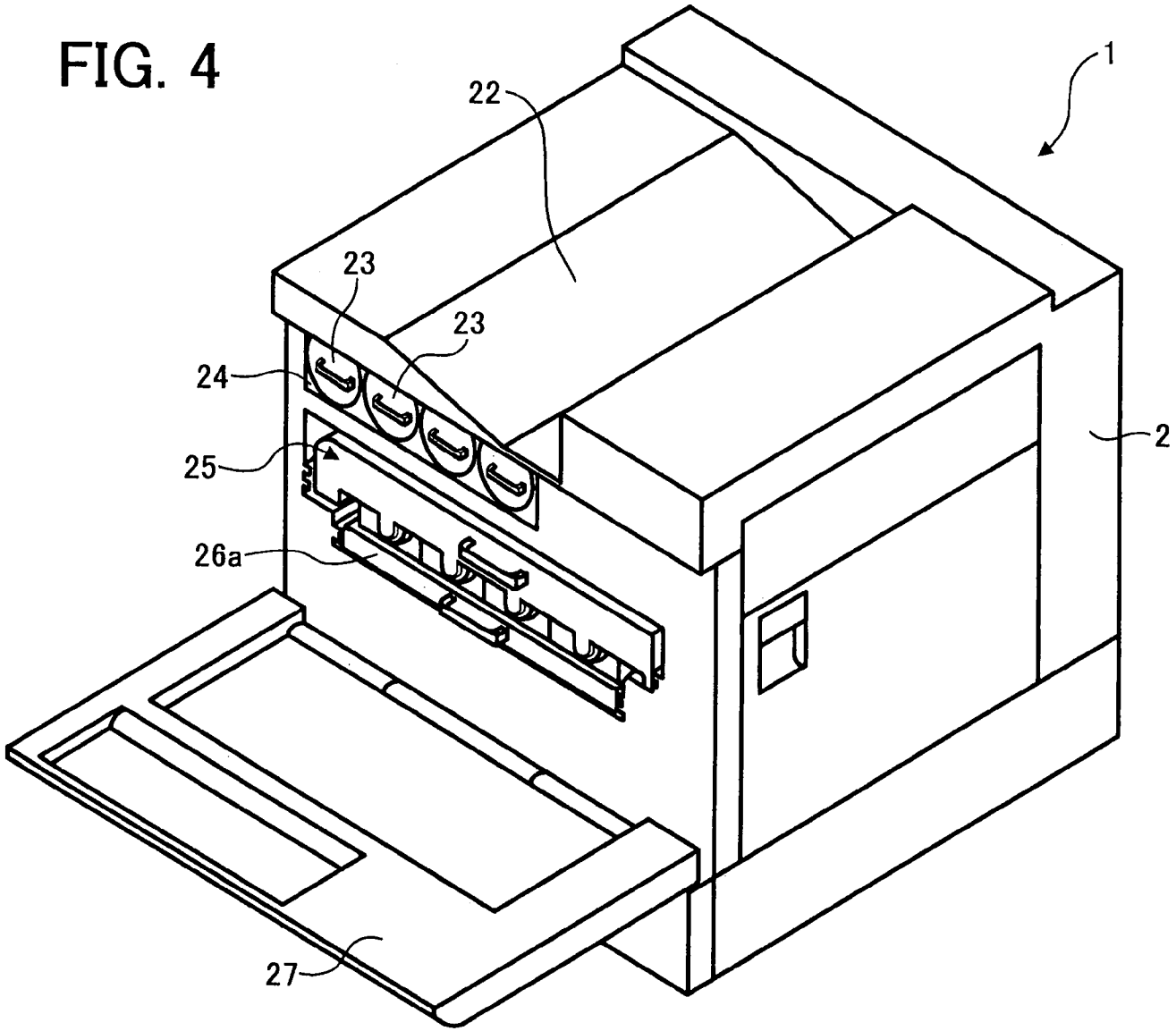
FIG. 4 is an isometric view of the apparatus in a condition wherein a front cover is opened.

FIG. 4 shows the printer in a condition wherein a front cover 27, mounted on the front end of the casing 2, is opened. In this condition, the image forming unit tray 26*a*, loaded with the four-image forming units 26, and toner bottle storage 24 are freely accessible in the event of replacement. A moving mechanism, not shown, is arranged between the image transferring unit 25 and image forming units 26 and configured to selectively move the image forming unit tray 26*a* upward or downward for thereby moving the image forming units 26 toward or away from the image transferring unit 25. More specifically, the moving mechanism lowers the image forming unit tray 26*a* downward when the operator of the printer opens the front cover 27 or raises the tray 26*a* when the operator closes the front cover 27. Alternatively, the moving mechanism may move the image forming unit tray 26*a* upward or downward with a cam operated by a lever.

Figure 3:
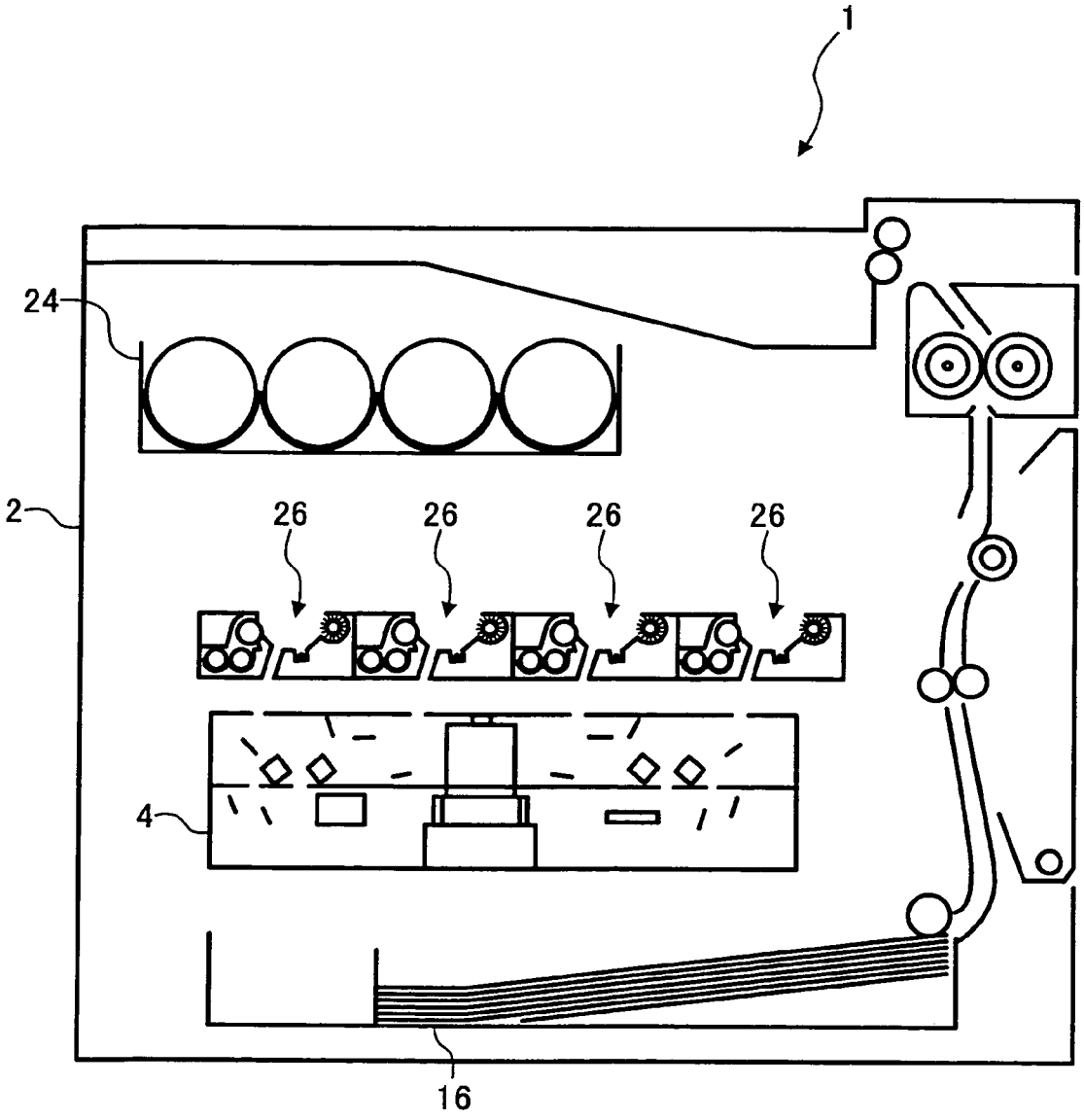
FIG. 3 is a front view showing the inside of the apparatus from which an image transferring unit included in the illustrative embodiment has been removed.
Figure 5:
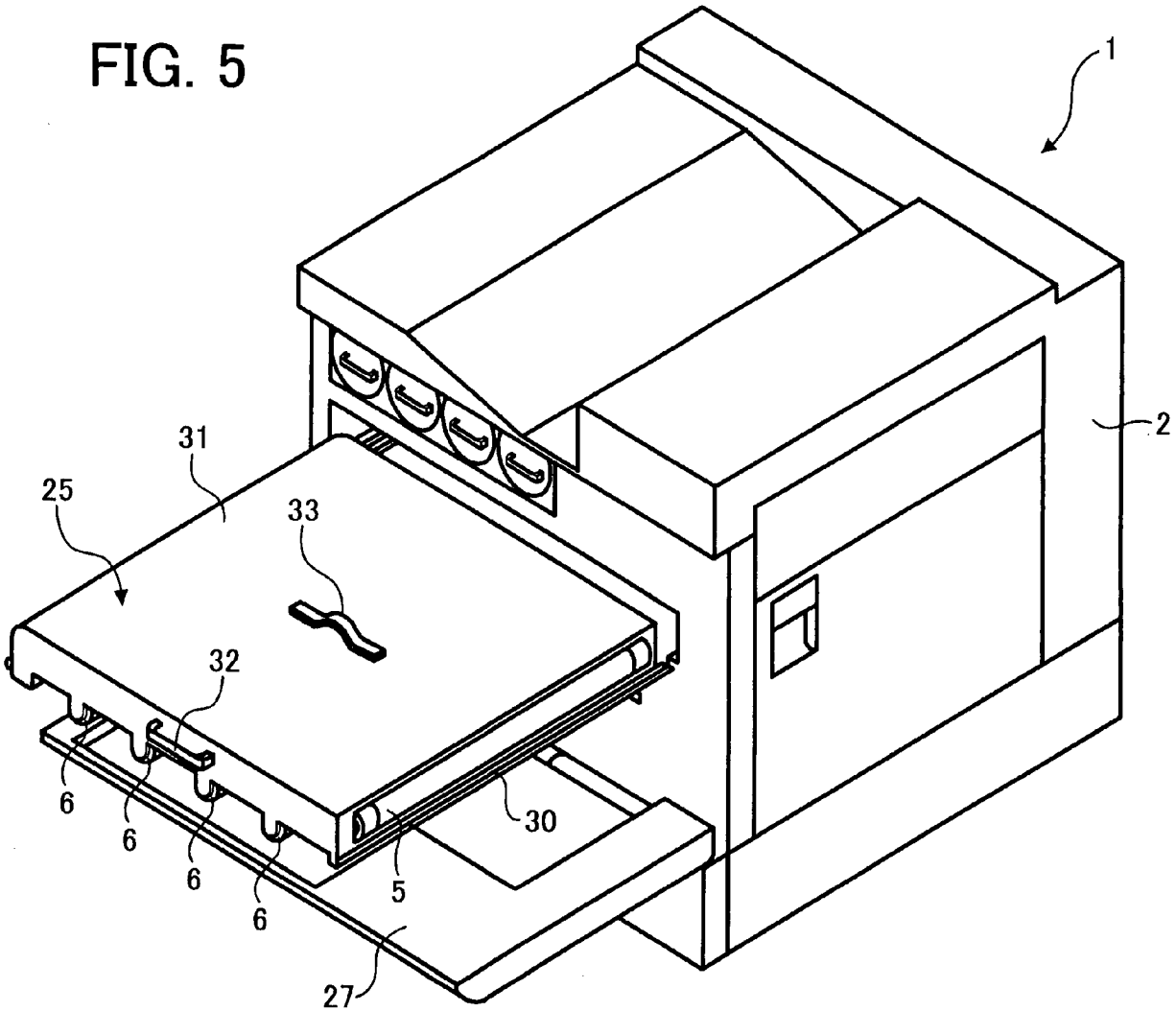
FIG. 5 is view similar to FIG. 4, showing a condition wherein the image transferring unit is pulled out.
Figure 6:
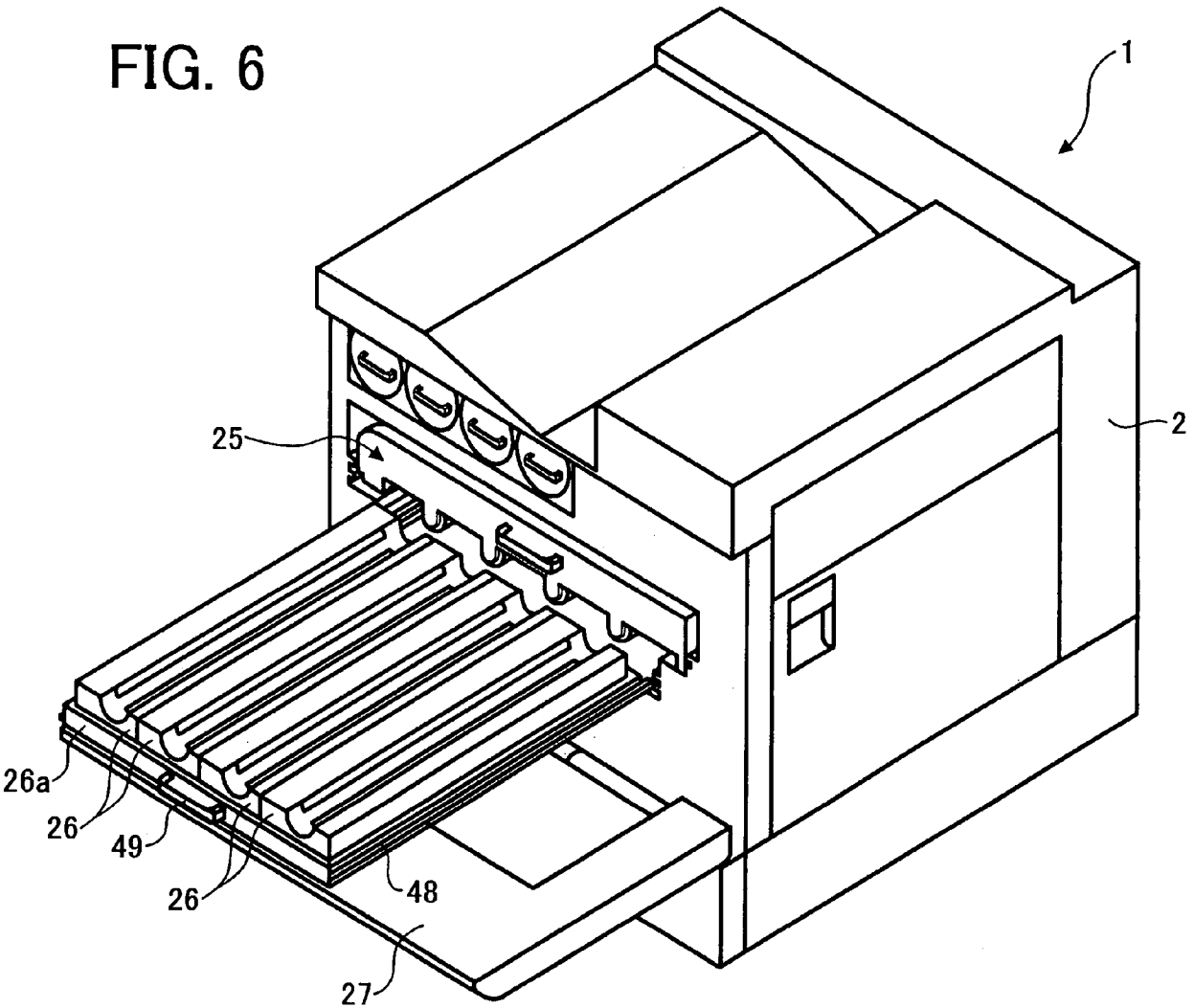
FIG. 6 is a view similar to FIG. 4, showing a condition wherein a developing unit is pulled out together with a developing unit tray.

FIG. 5 shows a condition wherein the image transferring unit 25 is pulled out from the casing 2 while FIG. 6 shows a condition wherein the image forming units 26 are pulled out from the casing 2. FIG. 3 is a front view showing the inside of the printer from which the image transferring unit 25 has been pulled out from the casing 2.

In the illustrative embodiment, the image transferring unit 25 and image forming units 26 each are removable from the casing 2 independently of each other, as stated above. Alternatively, an arrangement may be made such that the image transferring unit 25 and image forming units 26 can be pulled out integrally with each other, in which case the image forming unit 25 will be parted from the image forming units and replaced or the latter will be replaced after the former has been parted therefrom. This alternative arrangement makes the moving mechanism between the image transferring unit 25 and the image forming units 26 unnecessary, i.e., it suffices to position the image transferring unit 25 above the image forming units 26 at a preselected distance. As a result, the structure for mounting the image forming units 26 and image transferring unit 25 to the casing 2 is simplified.

Figure 7:
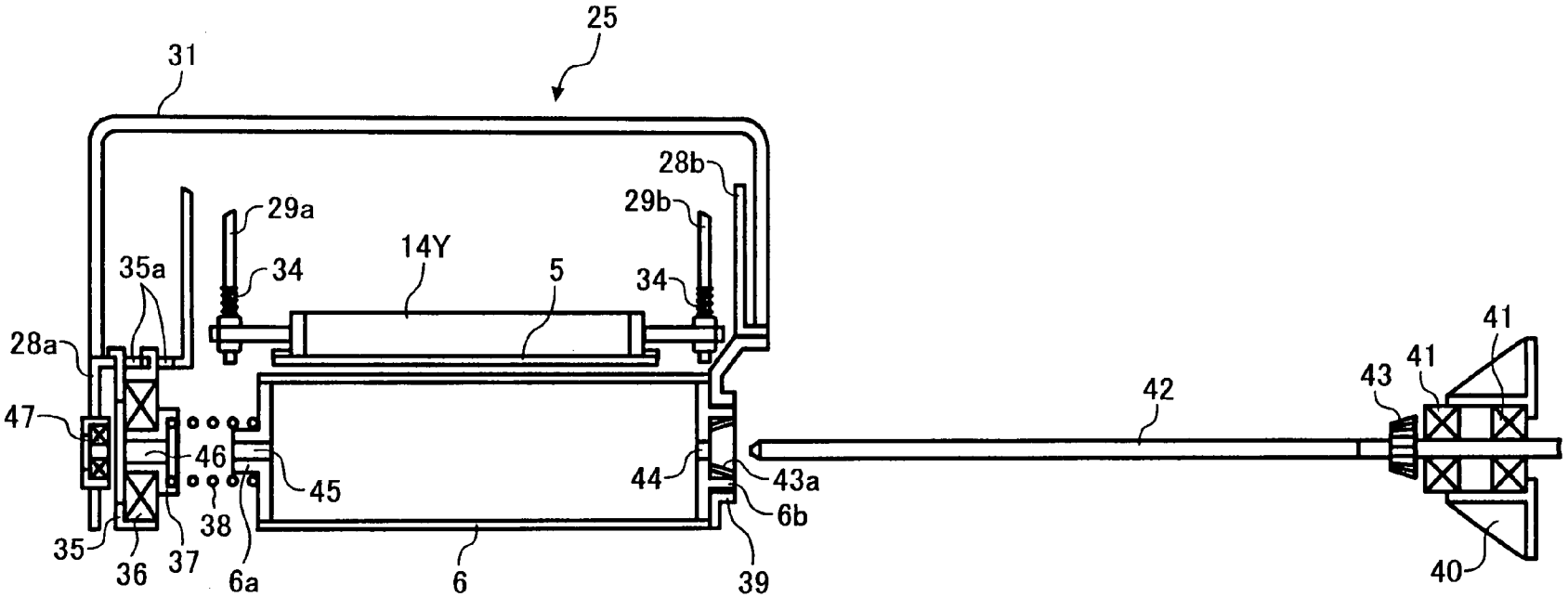
FIG. 7 is a vertical section showing a condition wherein the image transferring unit is removed from a casing.
Figure 8:
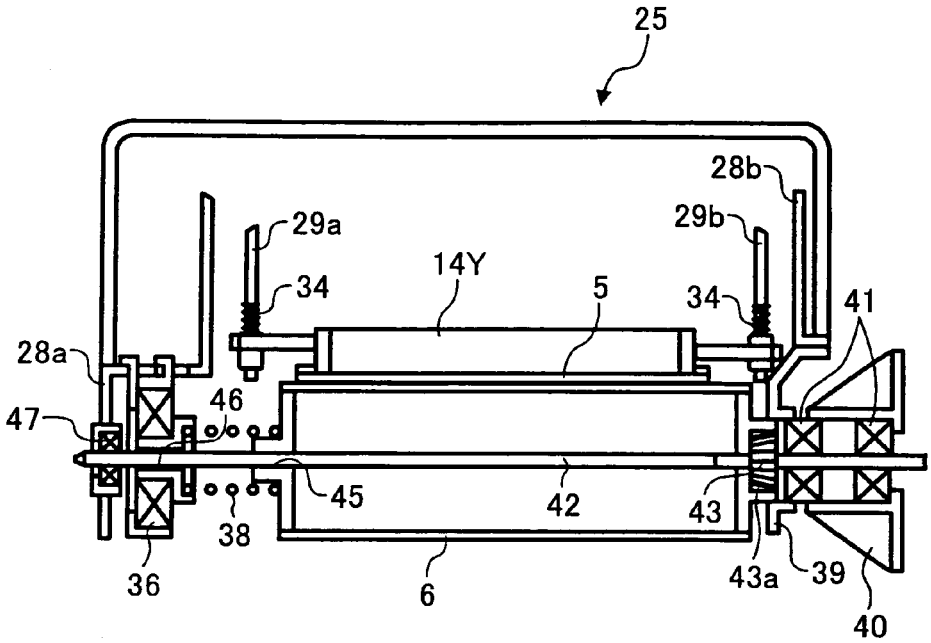
FIG. 8 is a vertical section showing a condition wherein the image transferring unit is mounted to the casing.

As shown in FIGS. 7 and 8, the image transferring unit 25 includes a frame including a front and a rear side wall 28*a* and 28*b* for supporting the belt 5, a pair of side wall 29*a* and 29*b* supporting the image transfer rollers 14Y, 14C and 14M, and stays, not shown, connecting the side walls 28*a* and 28*b* and side walls 29*a* and 29*b*. The rollers 11 through 13 and image transfer roller 14B are supported between the side walls 28*a* and 28*b*. Slide rails 30, see FIG. 5, are affixed to the stays, which form part of the image transferring unit 25, so that the image transferring unit 25 can be smoothly moved into or out of the casing 2. A cover 31, formed of resin, is affixed to the upper portion of the side walls 28*a* and 28*b*. As shown in FIG. 5, grips 32 and 33 are positioned on the front and top, respectively, of the cover 31, so that the operator can hold the grips 32 and 33 when mounting or dismounting the image transferring unit 25 to or from the casing 2. Springs 34 are anchored to the shaft portions of the image transfer roller 14, constantly biasing the roller 14 toward the drum 6.

The image transfer roller 14B is so located as to press the belt 6 against the drum 6. The other image transfer rollers 14Y, 14C and 14M are movable together with the side walls 29*a* and 29*b* between a position where they release the belt 5 from the drums 6, as shown in FIG. 7, and a position where they press the former against the latter.

How the image forming unit 25 holds the drums 6 will be described more specifically hereinafter. A front drum holder 35 is affixed to the side wall 28*a* while the outer lace of a ball bearing 36 is press-fitted in the front drum holder 35. A spring holder 37 is press-fitted in the inner lace of the ball bearing 36 while one end of a compression spring 38 is received in the spring holder 37. A flange 6*b*, protruding from the rear end of the drum 6, is received in a rear drum holder 39 with sufficient clearance. A flange 6*a*, protruding from the front end of the drum 6, is inserted in the other end of the compression spring 38. In this configuration, each drum 6 is held between the front and rear drum holders 35 and 39 by the compression spring 38 and removably held by the image transferring unit 25.

Four drum shaft holders 40 are affixed to a side wall, not shown, disposed in the casing 2, and each supports the shaft 42 of a particular drum 6. More specifically, the shaft 42 is supported by the drum shaft holder 40 via two ball bearings 41 while a coupling 43 is press fitted on the shaft 42. The shaft 42 extends horizontally and has a diameter of 12 mm at the rear side where the bearings 41 and coupling 43 are press-fitted and a diameter of 10 mm at the front side.

Reference will be made to FIGS. 7 and 8 for describing a structure for mounting the image transferring unit 25, which supports the belt 5 and four drums 6, to the casing 2 in detail. When the image transferring unit 25 is slid into the casing 2, the leading end portion of each shaft 42 is inserted into the associated drum 6 from the rear flange 6*b* toward the front flange 6*a* of the drum 6. When the image transferring unit 25 is slid into the casing 2 as far as a position where the 12 mm portion of the shaft 42 fits in a hole 44 formed in the rear flange 6*b* and having a diameter of 12 mm, the rear side of the drum 6 is positioned relative to the casing 2. At the same time, the coupling 43 is brought into mesh with a meshing portion 43*a* formed on the rear flange 6*b*, so that drive torque can be transferred from a drive source, not shown, to the drum 6. Further, part of the rear drum holder 39 is received in the outer lace of the ball bearing 41, positioning the entire image forming unit 25 relative to the casing 2.

The front end portion of the shaft 42 is inserted in a hole 45 formed in the rear flange 6*a* and having a diameter of 10 mm, a hole 46 formed in the spring holder 37 and having a diameter of 11 mm, and the inner lace of a bearing 47 mounted on the side wall 28*a* and having a diameter of 10 mm.

As shown in FIG. 6, slide rails 48 are affixed to opposite sides of the image forming unit tray 26*a* and allow the tray 26*a* to be slid into or out of the casing 2. A grip 49 protrudes from the front end of the image forming unit tray 26*a*, so that the operator can mount or dismount the tray 26*a* to or from the casing 2 by holding the grip 49.

In a color print mode, toner images of different colors are formed on the drums 6 and sequentially transferred to the belt 5 one above the other, completing a color toner image on the belt 5. When the sheet S fed from the sheet cassette 16 is nipped and conveyed by the belt 5 and secondary image transfer roller 19, the color toner image is transferred from the belt 5 to the sheet S. The color toner image is then fixed on the sheet S by the fixing unit 20. Subsequently, the sheet or color print S is driven out to the stack tray 22 by the outlet roller pair 21.

It is likely that the quality of the color image, formed on the sheet S by the above procedure, is lowered by various causes including scratches formed on the drums 6. Scratches on the drums 6 are, in many cases, ascribable to the belt 5. For example, when impurities, including residual toner and paper dust, adhere to the outer surface of the belt 5, they scratch the above surface in the form of spots when pressed against the surface. During image formation, the belt 5 and each drum 6 rarely contact each other at the same position so that the impurities on the belt 5 are pressed against different portions of the drum 6 every time image formation is repeated. As a result, the spot-like scratches on the drum 6 grow little by little and soon become stripe-like scratches. Such scratches capture a large amount of toner and appear in an image transferred to the sheet S as black stripes.

On the other hand, when impurities enter the nips between the inner surface of the belt 5 and the rollers 11 through 13, they cause corresponding projections to appear on the outer surface of the belt 15. The projections of the belt 15 also scratch the drum 6 in the form of spots when pressed against the drum 6. These spot-like scratches also become stripe-like scratches in due course and therefore appear in an image on the sheet S as black stripes for the same reason as stated in relation to the belt 5.

In the above situation, if only the drums 6 are replaced, then new drums 6 will also suffer from the same scratches in a short period of time, lowering image quality. Therefore, not only the scratched drums 6 but also the belt 5, causative of the scratches, must be replaced. For this reason, in the illustrative embodiment, the image transferring unit 2 is bodily replaced.

As shown in FIG. 4, to replace the entire image transferring unit 2, the operator opens the front cover 27. At this instance, the moving mechanism lowers the image forming unit tray 26*a* to thereby move the image forming units 26 away from the image transferring unit 25 in interlocked relation to the opening of the front cover 27. The operator then slides the image transferring unit 25 toward the front by holding the grip 32 of the unit 25, as shown in FIG. 5. Subsequently, the operator removes the image forming unit 25 from the casing 2 by holding the grips 32 and 33. At this instant, the four drums 6 are released from the respective shafts 42, as shown in FIG. 7. The operator then mounts a new image transferring unit 25 to the casing 2 in a sequence opposite to the above sequence, as shown in FIG. 8, and again closes the front cover 27.

As stated above, in the illustrative embodiment, when image quality on the sheet S is lowered due to the scratches of the drums 6, the operator can replace both of the drums 6 and belt 5, which is quite probably causative of scratches, at the same time. This makes replacing work far easier than when the drums 6 and belt 5 are replaced independently of each other. Further, such replacement can be performed without scratching or exposing the surfaces of the drums 6. As for exposure, the belt 5, positioned above the drums 6, serves to sufficiently intercept light otherwise being incident to the drums 6.

The degradation of image quality on the sheet S is sometimes not ascribable to the impurities adhered to the belt 5 or the projections of the belt 5, but ascribable to the individual drum 6, e.g., a film formed on the drum 6 by charge products. In such a case, as shown in FIG. 7, only the drum or drums 6, caused the degradation of image quality to occur, can be replaced after the removable of the image transferring unit 25 from the casing 2. For this purpose, the operator moves the drum 6 concerned toward the compression spring 38 against the bias of the spring 38 for thereby releasing the rear flange 6*b* from the rear drum holder 39. The operator then releases the front flange 6*a* from the end of the compression spring 38. To mount a new drum 6, the operator sets the new drum 6 and compression spring 38 on the front drum holder 35, inserts the rear side into the rear drum holder 39 while compressing the compression spring 38, and inserts the front drum holder 35 into a hole 35*a*, which is formed in the side wall 28*a*. As a result, the front drum holder 35 slides forward in the hole 35*a* under the action of the compression spring 38 and is prevented from slipping out of the hole 35*a* thereby.

As stated above, when the degradation of image quality is ascribable to a particular drum 6, only the particular drum 6 can be replaced with the other drums 6 and belt 5 being continuously used. This successfully obviates a wasteful increase in cost. Even when the image transferring unit 25 is positioned outside of the casing 2 for the replacement of a particular drum 6, the belt 5 positioned above the drums 6 protects the other drums 6, which are still usable, from external light.

Further, as shown in FIG. 4, after the image forming unit tray 26*a* has been lowered in interlocked relation to the opening of the front cover 27, the operator can pull out the tray 26*a* toward the front, as shown in FIG. 6. Subsequently, the operator can remove any one of the image forming units 26, including the charger 7, developing unit 8, and cleaning unit 9, from the image forming unit tray 26*a* and replace it with new one.

Generally, the charger 7, developing unit 8 and cleaning unit 9 are shorter in life than the drums 6 and belt 5 and therefore replaced more frequently than the drums 6 and belt 5. In the illustrative embodiment, the charger 7, developing unit 8 and cleaning unit 9, configured integrally with each other, can be replaced at the same time. This, coupled with the fact that such replacement can be performed without removing the drums 6 and belt 5 from the casing 2, promotes easy, rapid replacement of the units 7 through 9.

In the illustrative embodiment, the opening 9*a* of the cleaning unit 9 faces upward, as stated earlier. Therefore, even when any one of the image forming units 26 is removed from the casing 2 with the opening 9*a* remaining uncovered, waste toner, collected by the cleaning unit 9, is preventing from dropping via the opening 9*a*.

While the illustrative embodiment has concentrated on the drums 6 each playing role of an image carrier, photoconductive belts may be substituted for the drums 6, if desired.

Figure 10:
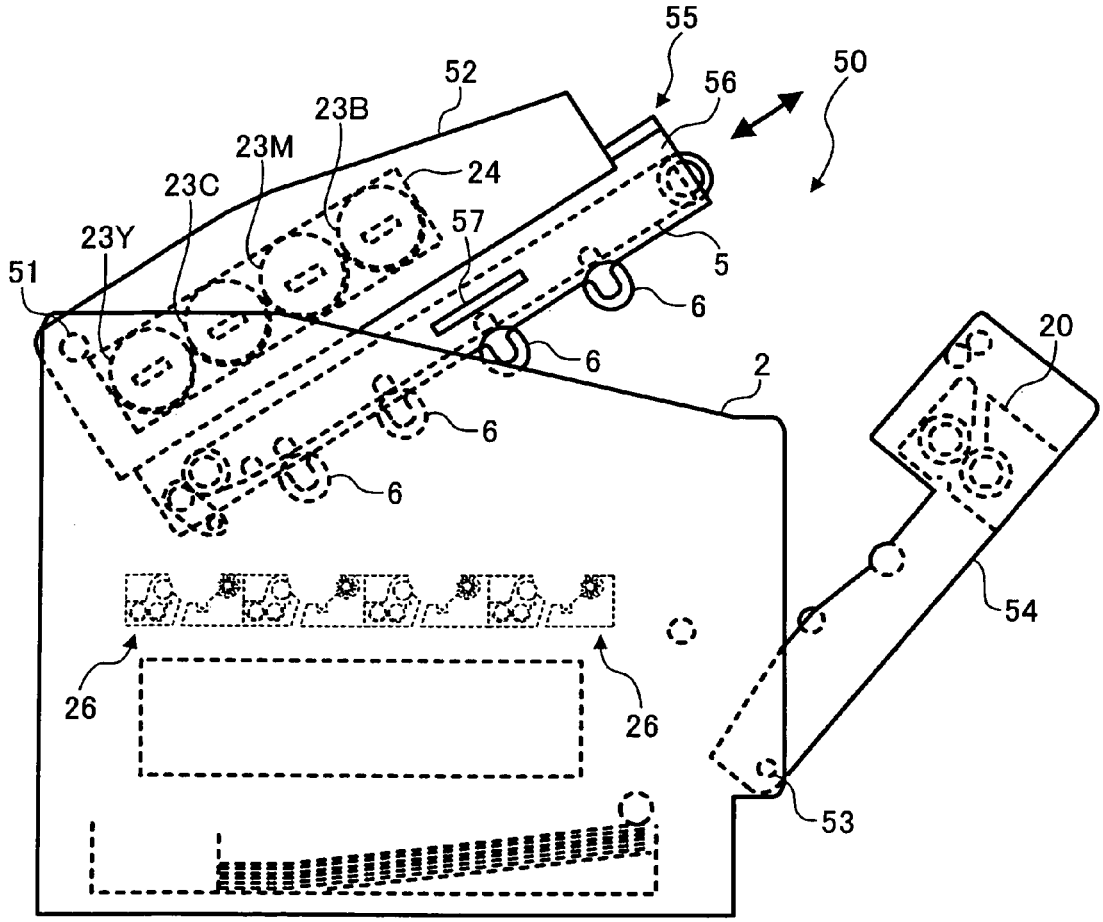
FIG. 10 is a front view showing a second embodiment of the present invention.

A second embodiment of the image forming apparatus in accordance with the present invention will be described with reference to FIG. 10. In FIG. 10, structural elements identical with those shown in FIGS. 1 through 9 are designated by identical reference numerals and will not be described specifically in order to avoid redundancy.

As shown in FIG. 10, a color printer 50 includes a top structural body 52 hinged to the upper portion of the casing 2 by a shaft 51 and a side structural body 54 hinged to the casing 2 by a shaft 53. The top structural body 52 includes the toner bottle storage 24 to which the toner bottles 23Y through 23B are removably mounted. The side structural body 54 includes the fixing unit 20.

An image transferring unit 55 is mounted on the bottom of the top structural body 52 and slidable in a direction indicated by an arrow in FIG. 10. The image transferring unit 55, basically identical with the image transferring unit 25, includes a frame 56 supporting the belt 5 and four drums 6. Grips 57 (only one is visible) are positioned on opposite side walls of the frame 56, so that the operator can slide the image transferring unit 55 in the above direction by holding the grips 57. The drums 6 each are supported by the frame 56 in such a manner as to be removable independently of the others.

The four image forming units 26 are removably disposed in the casing 2 while facing the four drums 6 mounted on the image transferring unit 55.

When the drums 6 with scratches and belt 5, which is presumably the cause of the scratches, should be replaced, the operator opens the top structural body 52 away from the casing 2 to the position shown in FIG. 10 and then pulls out the image transferring unit 55 from the top structural body 52 in the direction indicated by the arrow. Subsequently, the operator replaces the image transferring unit 55 with a new image transferring unit 55 and again closes the top structural body 52.

On the other hand, when the degradation of image quality is ascribable to any one of the drums 6 itself, the operator replaces only the drum 6 concerned while leaving the other drums 6 still usable and belt 5 in the image transferring unit 55.

Further, the operator may replace any one of the image forming units 26 by opening the top structural body 52 to thereby expose the image forming units 26.

Figure 11:
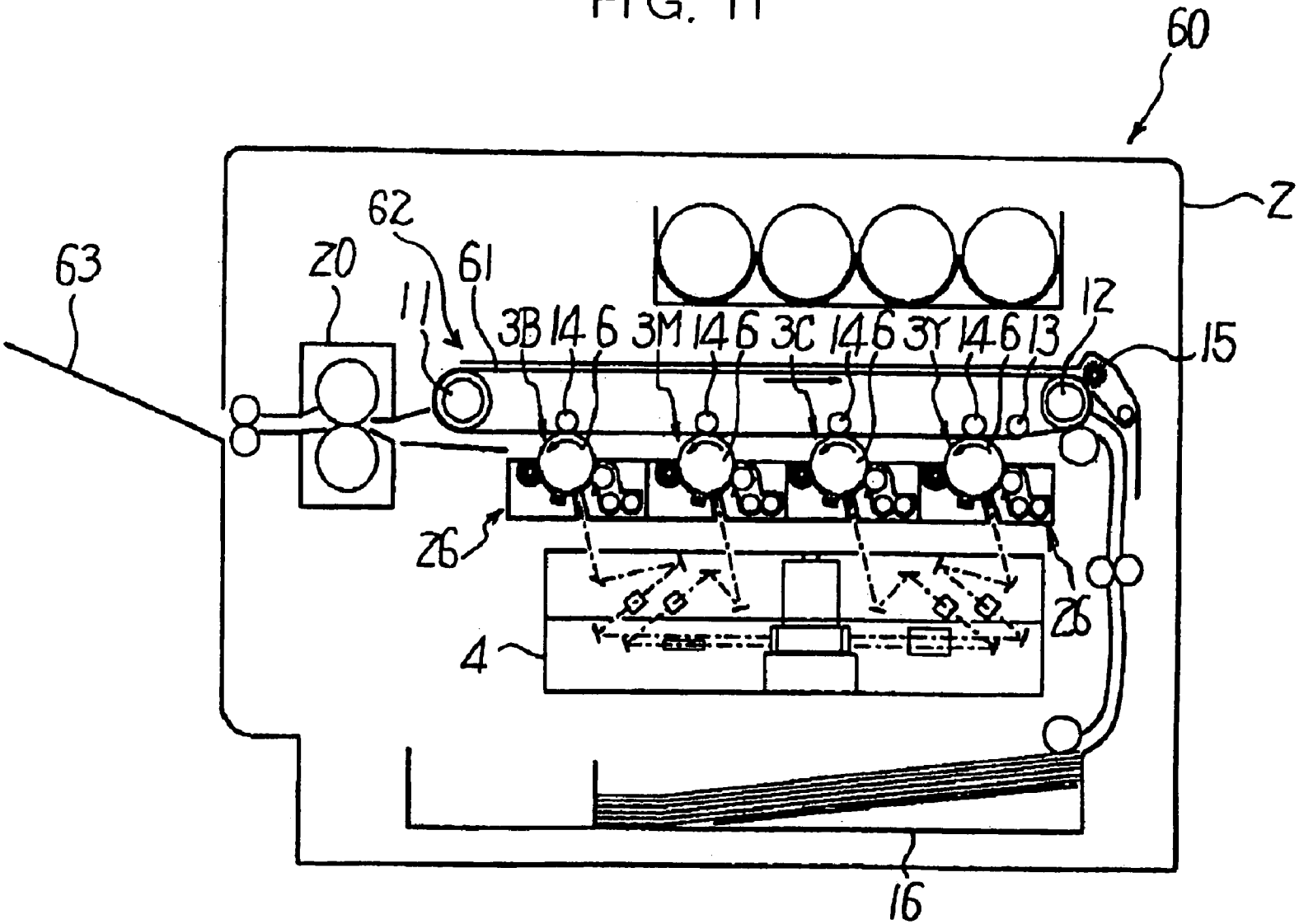
FIG. 11 is a front view showing a third embodiment of the present invention.
Figure 12:
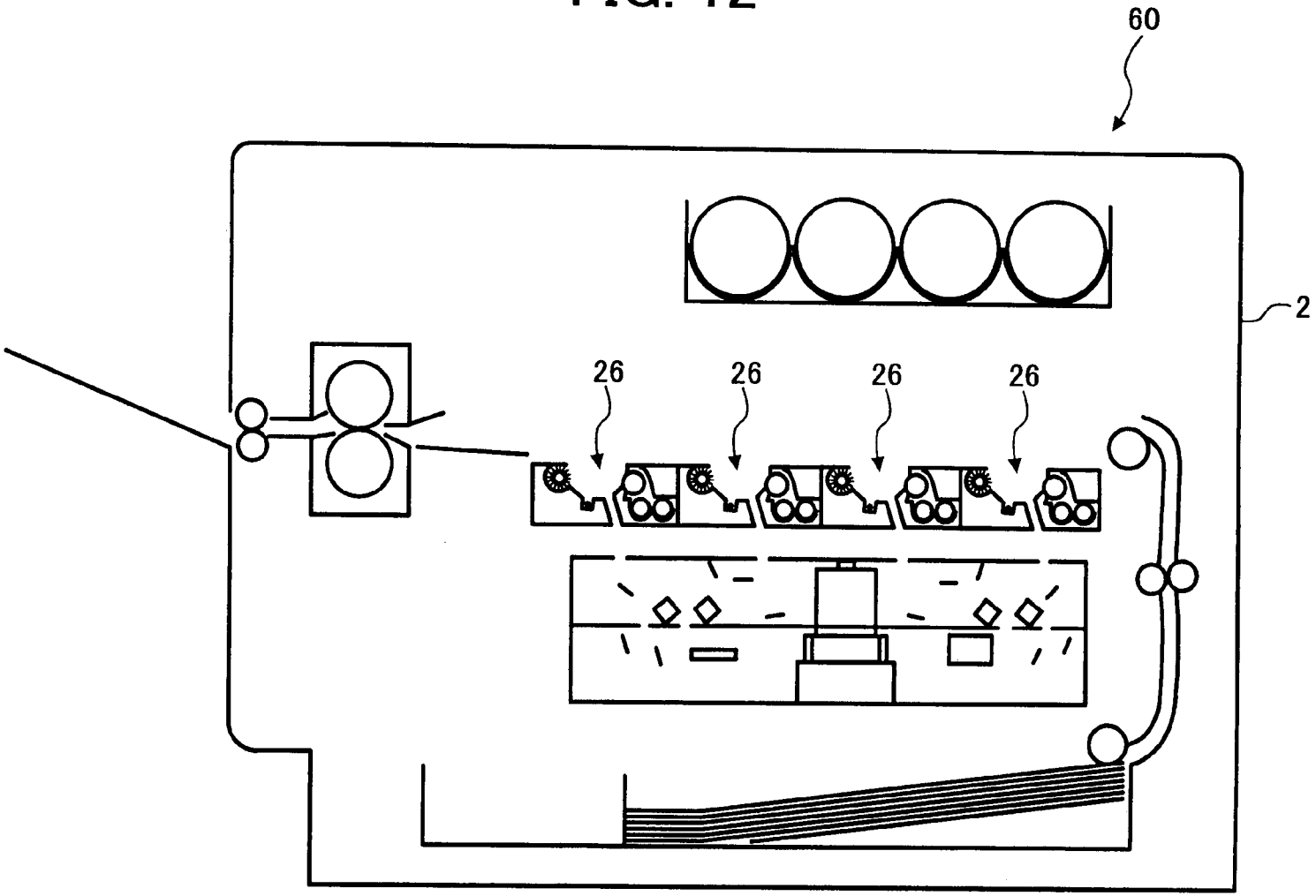
FIG. 12 is a front view showing an image transferring unit included in the third embodiment in a position removed from the casing.

Reference will be made to FIGS. 11 and 12 for describing a third embodiment of the image forming apparatus in accordance with the present invention. As shown, a color printer 60 is identical with the first embodiment except that it does not include an intermediate image transfer belt. Identical structural elements are designated by identical reference numerals.

More specifically, the color printer 60 includes a conveying belt 61 for conveying the sheet S and also playing the role of an image transferring member pressed against the drums 6. The conveying-belt (simply belt hereinafter) 61 is also passed over the rollers 11, 12 and 13 and caused to turn in a direction indicated by an arrow in FIG. 11 while electrostatically retaining the sheet S. The four image transfer rollers 14 are positioned inside of the loop of the belt 61 for transferring toner images of different colors from the drums 6 to the sheet S one above the other. The cleaning unit 15 is positioned outside of the loop of the belt 61 for removing impurities, including toner left on the belt 61 after image transfer and paper dust, from the belt 61.

In the illustrative embodiment, the four drums 6 and belt 61 are constructed into a single image transferring unit 62, which also includes the side walls 28*a*, 28*b*, 29*a* and 29*b* and stays shown in FIGS. 7 and 8. The belt 61 is positioned above the drums 6 while each drum 6 is removable from the image transferring unit 62.

The image transferring unit 62 is removably mounted to the casing 2. FIG. 11 shows the inside of the printer 60 with the image transferring unit 62 mounted thereto while FIG. 12 shows the inside of the same from which the image forming unit 62 has been removed.

In a color print mode, toner images of different colors are formed on the drums 6 and sequentially transferred to the sheet S, which is fed from the sheet cassette 16 and being conveyed by the conveying belt 61, one above the other, completing a color toner image on the sheet S. The color toner image is then fixed on the sheet S by the fixing unit 20. Subsequently, the sheet or color print S is driven out to the stack tray 22 by the outlet roller pair 21.

In the color printer 60 described above, it is likely that the quality of the color image, formed on the sheet S by the above procedure, is lowered by various causes including scratches formed on the drums 6. Scratches on the drums 6 are, in many cases, ascribable to the belt 61. For example, when impurities, including residual toner and paper dust, adhere to the outer surface of the belt 61, they are not directly pressed against the drums 6 during image formation because the sheet S intervenes between the belt 61 and the drums 6. However, the belt 61 is pressed against the drums 6 at the interval between consecutive sheets S. As a result, the impurities adhered to the outer surface of the belt 61 are pressed against the drums 6 like he impurities adhered to the belt 5 of the first embodiment, forming stripe-like scratches on the drums 6 stated earlier. Such scratches capture a large amount of toner and appear in an image transferred to the sheet S as black stripes.

On the other hand, when impurities enter the nips between the inner surface of the belt 61 and the rollers 11 through 13, they cause corresponding projections to appear on the outer surface of the belt 61. The projections of the belt 61 also scratch the drum 6 in the form of spots when pressed against the drum 6. These spot-like scratches also become stripe-like scratches and therefore appear in an image on the sheet S as black stripes.

In the above situation, if only the drums 6 are replaced, then new drums 6 will also suffer from the same scratches in a short period of time, lowering image quality. Therefore, not only the scratched drums 6 but also the belt 61, causative of the scratches, must be replaced. For this reason, in the illustrative embodiment, too, the image transferring unit 62 is bodily replaced. To replace the image transferring unit 62, the operator opens the front cover 27, FIG. 4, and then pulls out the image transferring unit 62 toward the front in the same manner as in the first embodiment.

As stated above, when image quality on the sheet S is lowered due to the scratches of the drums 6, the operator can replace both of the drums 6 and belt 61, which is quite probably causative of scratches, at the same time. This makes replacing work far easier than when the drums 6 and belt 61 are replaced independently of each other. Further, such replacement can be performed without scratching or exposing the surfaces of the drums 6.

The degradation of image quality on the sheet S is sometimes not ascribable to the impurities adhered to the belt 61 or the projections of the belt 61, but ascribable to the individual drum 6, e.g., a film formed on the drum 6 by charge products. In such a case, the operator removes the image transferring unit 62 from the casing 2 and then replaces only the drum 6 concerned while leaving the other drums 6 still usable and belt 61 in the image transferring unit 62 as in the first embodiment.

In the illustrative embodiment, too, the image transferring unit 62 and image forming units 26 each are removable from the casing 2 independently of each other. Alternatively, an arrangement may be made such that the image transferring unit 62 and image forming units 26 can be pulled out integrally with each other, in which case the image forming unit 62 will be parted from the image forming units 26 and replaced or the latter will be replaced after the former has been parted therefrom. This alternative arrangement makes the moving mechanism between the image transferring unit 62 and the image forming units 26 unnecessary, i.e., it suffices to position the image transferring unit 62 above the image forming units 26 at a preselected distance As a result, the structure for mounting the image forming units 62 and image transferring unit 26 to the casing 2 is simplified.

Figure 13:
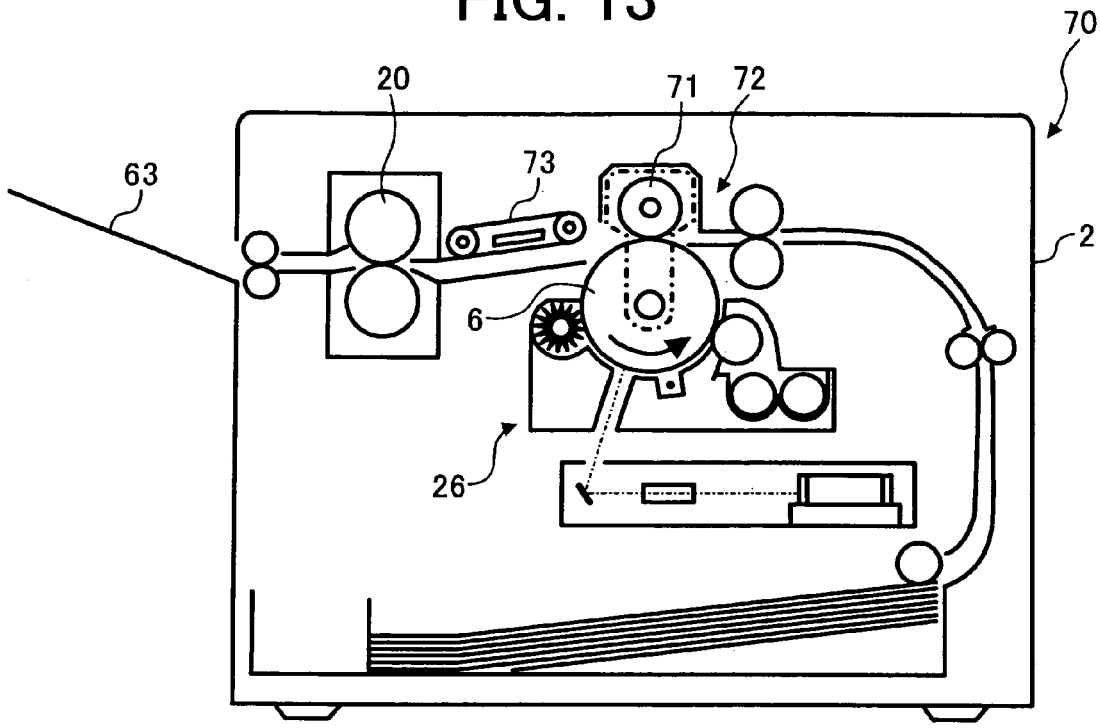
FIG. 13 is a front view showing a fourth embodiment of the present invention.
Figure 14:
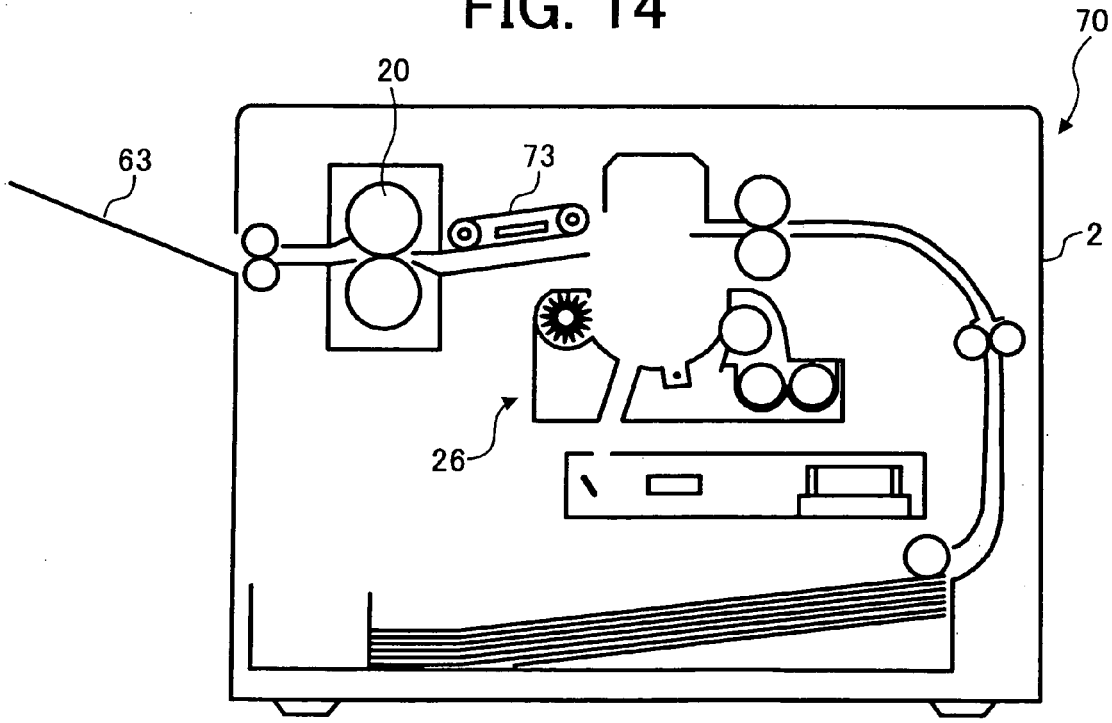
FIG. 14 is a front view showing an image transferring unit included in the fourth embodiment in a position removed from the casing.

FIGS. 13 and 14 show a fourth embodiment of the image forming apparatus in accordance with the present invention. As shown, the illustrative embodiment is implemented as a monochromatic printer 70 as distinguished from the tandem color printer described above. As shown, the printer 70 includes a single photoconductive drum 6 and an image transfer roller or image transfer member 71 pressed against the drum 6. The drum 6 and image transfer roller 71 are supported by a single frame, not shown, together, constituting an image transferring unit 72. The drum 6 is removable from the image transferring unit 72.

A conveying belt 72 is positioned between the image transferring unit 72 and the fixing unit 20 and conveys the sheet S, carrying a monochromatic toner image thereon, while electrostatically retaining the sheet S on its lower run.

The image transferring unit 72 is removably mounted to the casing 2. The operator can remove the image transferring unit 72 from the casing 2 by opening the front cover and pulling out the unit 72 as in the first and third embodiments. FIG. 13 shows the inside of the printer 70 with the image transferring unit 72 mounted thereto while FIG. 14 shows the inside of the same from which the unit 72 has been removed. A single image forming unit 26, including the charger 7, developing unit 8 and cleaning unit 9, is mounted on a developing unit tray as in the first embodiment. The operator may pull out the image forming unit 26 together with the developing unit tray and then remove the former from the latter.

In operation, a toner image, formed on the drum 6, is transferred to the sheet S fed from the sheet cassette 16 and pressed against the drum 6 by the image transfer roller 71. The sheet S has the toner image fixed by the fixing unit 20 and then driven out to a print tray 63.

In the monochromatic printer 70 described above, it is likely that the quality of the color image, formed on the sheet S by the above procedure, is lowered by various causes including scratches formed on the drum 6. Scratches on the drum 6 are, in many cases, ascribable to the belt 71. For example, when impurities, including residual toner and paper dust, adhere to the outer surface of the belt 71, they are sometimes directly pressed against the drums 6 during image formation. As a result, the impurities adhered to the outer surface of the belt 71 form stripe-like scratches on the drums 6 stated earlier. Such scratches capture a large amount of toner and appear in an image transferred to the sheet S as black stripes. In such a situation, if only the drum 6 is replaced, then a new drum 6 will also suffer from the same scratches in a short period of time, lowering image quality. Therefore, not only the scratched drum 6 but also the belt 71, causative of the scratches, must be replaced. For this reason, in the illustrative embodiment, the image transferring unit 72 is bodily replaced. To replace the image transferring unit 71, the operator opens the front cover 27, FIG. 4, and then pulls out the image transferring unit 72 toward the front in the same manner as in the first embodiment.

As stated above, when image quality on the sheet S is lowered due to the scratches of the drum 6, the operator can replace both of the drum 6 and belt 71, which is quite probably causative of scratches, at the same time. This makes replacing work far easier than when the drum 6 and belt 71 are replaced independently of each other.

On the other hand, when the degradation of image quality on the sheet S is ascribable to the drum 6, e.g., when a film of charge products is formed on the drum 6, the operator can remove the image transferring unit 72 from the casing 2 and then replace only the drum 6 while leaving the image transfer roller 71 in the image transferring unit 72.

The image transfer roller 71, serving as an image transferring member in the illustrative embodiment, may be replaced with a conveying belt and a single image transfer roller contacting the inner surface of the belt.

Again, an arrangement may be made such that the image transferring unit 72 and image forming units 26 can be pulled out integrally with each other, in which case the image transferring unit 72 will be parted from the image forming unit 26 and replaced or the latter will be replaced after the former has been parted therefrom. This alternative arrangement makes the moving mechanism between the image transferring unit 72 and the image forming units 26 unnecessary, i.e., it suffices to position the image transferring unit 72 above the image forming units 26 at a preselected distance. As a result, the structure for mounting the image forming units 26 and image transferring unit 72 to the casing 2 is simplified.

In the illustrative embodiments shown and described, the charger 7, which is one of image forming means, does not contact the drum 6. Therefore, even when impurities adhere to the charger 7, they are preventing from being pressed against the drum 6 and scratching it. It follows that the charger 7 can be replaced at different timing from the image transferring unit. This is also true with the developing unit 8. Also, even when impurities adhere to the cleaning unit 9, which uses a brush contacting the drum 6, they are prevented from being pressed against and scratching the drum 6. The cleaning unit 9 can therefore be replaced at different timing from the image transferring unit.

Various modifications will become possible for those skilled in the art after receiving the teachings of the present disclosure without departing from the scope thereof.

What is claimed is:

1. An image forming apparatus for transferring a toner image formed on a circumferential surface of a photoconductive element included in said image forming apparatus to a recording medium, said image forming apparatus comprising:

a casing enclosing a body of said image forming apparatus;

an image forming unit including a cleaning device arranged around said photoconductive element;

an image transfer unit mounted on said body in said casing and integrally supporting at least one photoconductive element and an image transfer member associated with said at least one photoconductive element, said image transfer unit being removable from said casing independently of said image forming unit;

a slide mechanism configured to allow said image transfer unit to be pulled out of the body;

a first handle mounted on one end face of said image transfer unit perpendicular to an axis of said at least one photoconductive element and provided to allow said image transfer unit to be slid by hand; and a second handle mounted on a surface of said image transfer unit parallel to the axis of said at least one photoconductive element and provided to allow said image transfer unit to be removed from the body.

2. The apparatus as claimed in claim 1, wherein said at least one photoconductive element mounted on said image transfer unit comprises a plurality of photoconductive elements configured to form a respective toner image of a particular color thereon each, and said image transfer member mounted on said image transfer unit comprises an intermediate image transfer belt on which toner images formed on said plurality of photoconductive elements are sequentially transferred one above another.

3. The apparatus as claimed in claim 2, wherein said intermediate image transfer belt is positioned above said plurality of photoconductive elements.

4. The apparatus as claimed in claim 1, wherein said at least one photoconductive element mounted on said image transfer unit comprises a plurality of photoconductive elements configured to form a respective toner image of a particular color thereon each, and said image transfer member comprises a belt for conveying the recording medium while pressing said recording medium against circumferential surfaces of said plurality of photoconductive elements.

5. The apparatus as claimed in claim 4, wherein said belt is positioned above said plurality of photoconductive elements.

6. The apparatus as claimed in claim 1, wherein said at least one photoconductive element mounted on said image transfer unit comprises a single photoconductive element while said image transfer member comprises an image transfer roller configured to press the recording medium to a circumferential surface of said single photoconductive element.

7. The apparatus as claimed in claim 1, wherein said at least one photoconductive element is removable from said image transfer unit when said image transfer unit is removed from said body.

8. An image transfer unit removably mounted on a body enclosed in a casing of an image forming apparatus and integrally supporting a photoconductive element and an image transfer member associated with said photoconductive element, said image transfer unit comprising:

a first handle mounted on one end face of said image transfer unit perpendicular to an axis of said photoconductive element and provided to allow said image transfer unit to be slid by hand; and a second handle mounted on a surface of said image transfer unit parallel to the axis of said photoconductive element and provided to allow said image transfer unit to be removed from the body, wherein said image transfer unit is removable from said casing independently of an image forming unit including a cleaning device arranged around said photoconductive element.

9. An image forming apparatus for transferring a toner image formed on a circumferential surface of a photo conductive element included in said image forming apparatus to a recording medium, said image forming apparatus comprising:

a casing enclosing a body of said image forming apparatus;

an image forming unit including a plurality of cleaning devices;

an image transfer unit mounted on said body in said casing and including a plurality of photoconductive elements and an image transfer member associated with said plurality of photoconductive elements, said plurality of photoconductive elements each having axes substantially parallel to each other;

a slide mechanism configured to allow said image transfer unit to be pulled out of the body; and a handle mounted on one end face of said image transfer unit and provided to allow said image transfer unit to be slid by hand, wherein said plurality of cleaning devices of said image forming unit are arranged around said plurality of photoconductive elements of said image transfer unit, respectively, said image transfer unit is removable from said casing independently of said image forming unit, and said handle is mounted in perpendicular to a direction of axes of said plurality of photoconductive elements.

10. An image transfer unit removably mounted on a body enclosed in a casing of an image forming apparatus and integrally supporting a plurality of photoconductive elements and an image transfer member associated with said plurality of photoconductive elements, said image transfer unit comprising:

a handle mounted on one end face of said image transfer unit perpendicular to a direction of axes of said plurality of photoconductive elements and provided to allow said image transfer unit to be slid by hand, wherein said image transfer unit is removable from said casing independently of an image forming unit including a plurality of cleaning devices arranged around said plurality of photoconductive elements, respectively.

11. A unit configured to be used with an image forming apparatus, the unit comprising:

a plurality of photoconductive drums arranged in a straight line;

an intermediate transfer device associated with said plurality of photoconductive drums; and a handle arranged in parallel with the straight line.

12. The unit as claimed in claim 11, wherein the handle is mounted on the unit.

13. The unit as claimed in claim 11, wherein the handle is mounted on the unit in a direction perpendicular to the axes of the photoconductive drums.

14. The unit as claimed in claim 11, wherein the handle is configured to be grasped to allow the unit to be removed from the image forming apparatus.

15. The unit as claimed in claim 11, wherein the handle is configured to be grasped to allow the unit to be removed between a first position and a second position.

16. The unit as claimed in claim 11, wherein the handle is mounted in a direction perpendicular to an axis of one of the plurality of photoconductive drums.

17. The unit as claimed in claim 16, wherein the handle is mounted in a direction perpendicular to axes of at least two of the plurality of photoconductive drums.

18. The unit as claimed in claim 17, wherein the handle is configured to permit removal of the unit from the image forming apparatus.

19. The unit as claimed in claim 11, wherein said intermediate transfer device contains an intermediate transfer belt.

* * * * *